United States Patent [19]

O'Neill

[11] 3,995,627

[45] Dec. 7, 1976

[54] DIVING HELMET SYSTEM

[75] Inventor: Wilbur J. O'Neill, Severna Park, Md.

[73] Assignee: Westinghouse Electric Corporation, Pittsburgh, Pa.

[22] Filed: Nov. 15, 1972

[21] Appl. No.: 306,944

[52] U.S. Cl. ..... 128/142.7; 2/2.1 R

[51] Int. Cl.[2] ..... A62B 18/04

[58] Field of Search ..... 128/142.2–142.7, 128/142, 141; 2/2.1 R, 3, 5, 6, 9, 2.1 A, 205

[56] References Cited

UNITED STATES PATENTS

| | | | |
|---|---|---|---|
| 968,232 | 8/1910 | Bentz | 128/142 |
| 2,388,604 | 11/1945 | Eisenbud | 128/142.3 |
| 2,388,674 | 11/1945 | Browne | 2/2.1 R X |
| 2,626,602 | 1/1953 | Buie | 128/142.5 |
| 2,764,151 | 9/1956 | Cupp | 128/142.2 |
| 3,292,618 | 12/1966 | Davis et al. | 128/142.2 X |
| 3,293,659 | 12/1966 | Shepard | 128/142.7 X |
| 3,348,539 | 10/1967 | McDonald | 128/142.2 |
| 3,362,403 | 1/1968 | Fleming et al. | 2/6 X |
| 3,474,782 | 10/1969 | Cupp | 128/142 |

*Primary Examiner*—Robert W. Michell
*Assistant Examiner*—Lee S. Cohen
*Attorney, Agent, or Firm*—D. Schron

[57] ABSTRACT

Described is a diving helmet having receptacles for receiving insertable modular valves or plugs for governing gas flow. The receptacles are diametrically opposed on the helmet and are connected by gas conducting conduits. Gas may be supplied to the diver by way of a main supply duct which discharges the gas against the helmet window for defogging purposes. A sealing arrangement is provided with the diver, and particular valves or plugs are inserted into the receptacles in accordance with a particular gas supply system being utilized.

14 Claims, 24 Drawing Figures

FIG. 1
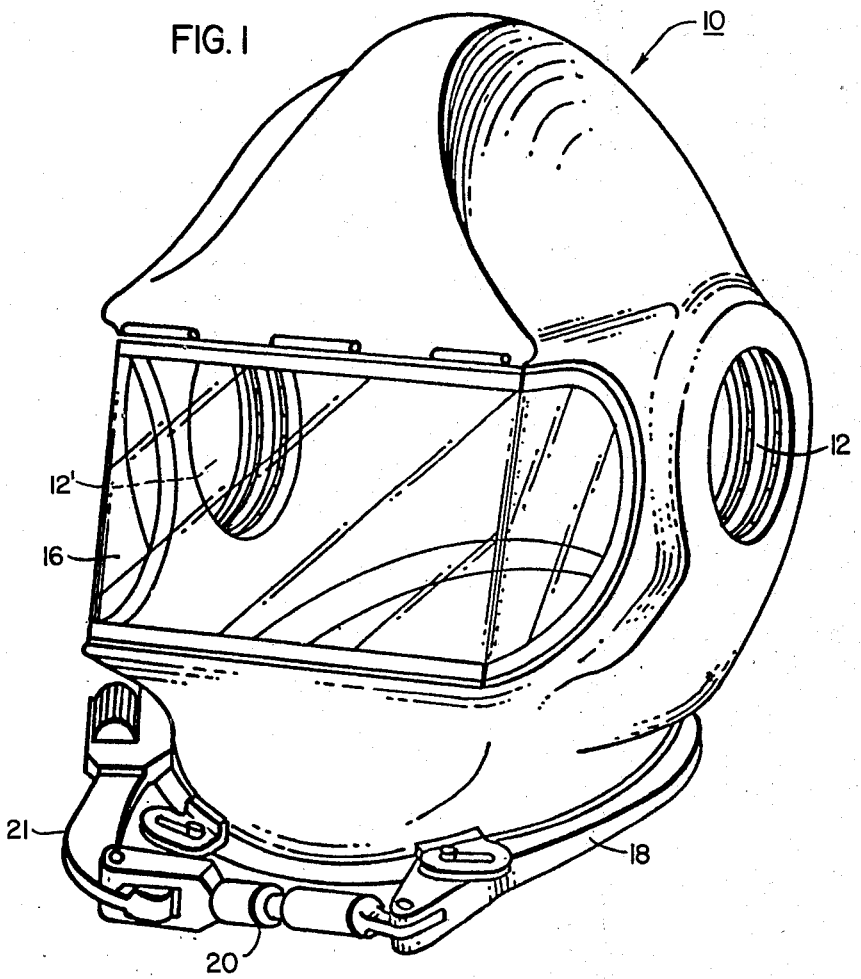
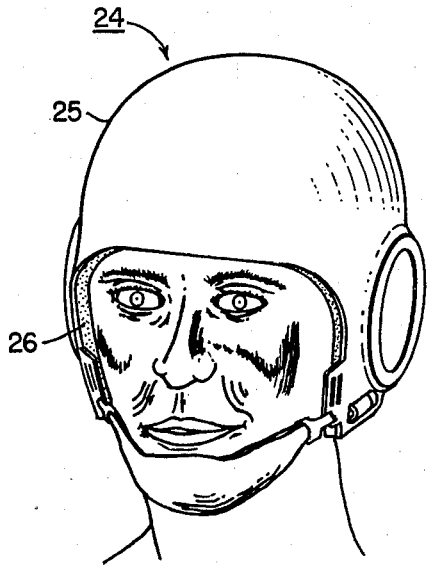
FIG.2

DIVING HELMET SYSTEM

CROSS REFERENCE TO RELATED APPLICATIONS

The present case is related in subject matter to copending application Ser. No. 306,945, filed Nov. 15, 1972, and assigned to the same assignee as the present invention.

BACKGROUND OF THE INVENTION

1. Field of the Invention

The present invention in general relates to diving helmets, and particularly to diving helmets utilizable with a variety of gas supply systems.

2. Description of the Prior Art

Working in the underwater environment requires a variety of gas supply systems dependent upon, for example, diver working depth and the mission or task to be performed. For example, in shallow water use may be made of scuba equipment utilizing a shallow water face mask and mouth piece. For operation from the surface down to about 180 feet use is made of the common hard hat dress with an air supply and for deeper depths, with a mixed gas supply, helium and oxygen, instead of air.

Fully closed and semi-closed rigs may utilize different helmets and face seals and some mission requirements have divers living underwater in a habitat and when working out of the habitat the divers are supplied with a breathable gas mixture which is returned to the habitat for $CO_2$ scrubbing and oxygen makeup.

Accordingly, a diver to be able to work the full spectrum of diving requires a well equipped diving locker with as many as six or seven different masks or helmets for working in different depth ranges with different gas supplies. All of this necessary apparatus carries its burden of cost, requires spare parts and excessive maintenance, and particularly requires the training of the diver in the use of all of the various pieces of apparatus.

The present invention is a standardized helmet adaptable to all tasks and provides a compatibility between the diver and the various modes of breathing gas supply.

SUMMARY OF THE INVENTION

The diving helment system of the present invention is the interface between the diver and the gas supply system and includes a diving helmet body which has mounted thereon receiver means for receipt of insertable gas flow control modules. These modules which may be plugs or valves are chosen in accordance with the particular task and accordingly with the particular gas supply arrangement. In the preferred case, two such receivers are utilized and gas passageways or ducts are included to provide gas communication between the receivers and with various components of the helmet system.

A gas supply duct is provided such that gas entering the helmet is utilized to defog the helmet window and the input means for the gas supply includes two different sized inputs located at the rear of the helmet body.

A sealing means is included in order to effect a diving helmet to diver seal and this sealing means may remain the same for any diver mission, the only adaptation required being some minor modifications including the insertion of particular gas flow control modules and the possible utilization of an oral-nasal mask.

BRIEF DESCRIPTION OF THE DRAWING

FIG. 1 illustrates a diving helmet body in accordance with the present invention;

FIG. 2 illustrates a preferred mode of adapting the helmet of FIG. 1 to the diver;

DESCRIPTION OF THE PREFERRED EMBODIMENT

Figure 3:
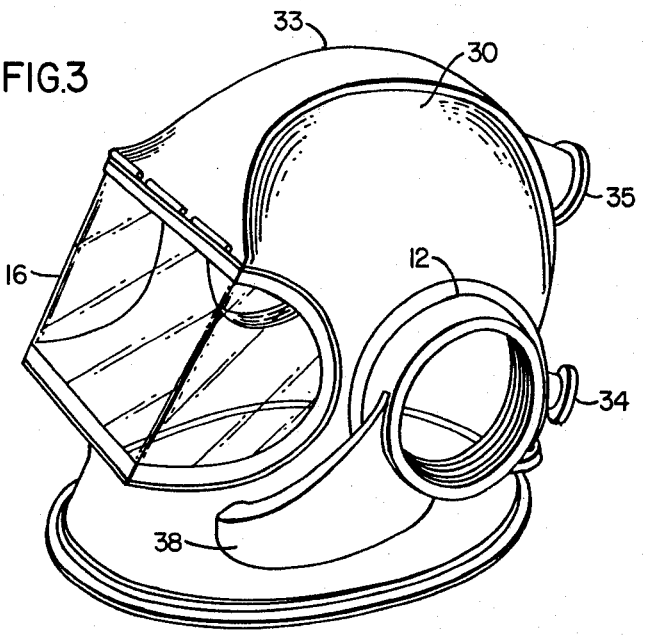
FIGS. 3, 4 and 5 are three different views of the subsurface portions of the helmet body of FIG. 1.

Referring now to FIG. 1, there is illustrated a helmet body 10 which includes receptacle or receiver means 12 and 12' each being for receipt of a particular insertable gas flow control module, with the receivers being diametrically opposed on the helmet body.

The helmet body additionally includes a window 16 and a suitable sealing arrangement is provided such as to seal to a diver's suit, vest, and/or neck in order to maintain gas integrity. As part of the sealing arrangement, the helmet body 10 includes a clamping means 18 operable by means of a locking mechanism 20 including an actuating arm 21. One type of sealing arrangement wherein the seal is effected at the diver's neck, is described in greater detail in the aforementioned copending application.

The helmet body is meant to be a standard helmet adaptable to all tasks and to further make it adaptable to all diver head sizes it is preferable that the inner surface of the helmet body 10 be of a standardized contour to mate with a standardized adapter unit 24 as shown in FIG. 2. The adapter unit 24 includes an inner liner shell 25, being of the standardized shape, and padding means 26 which is contoured to the diver's head. Such an arrangement is further described and claimed in the mentioned patent application.

Figure 4:
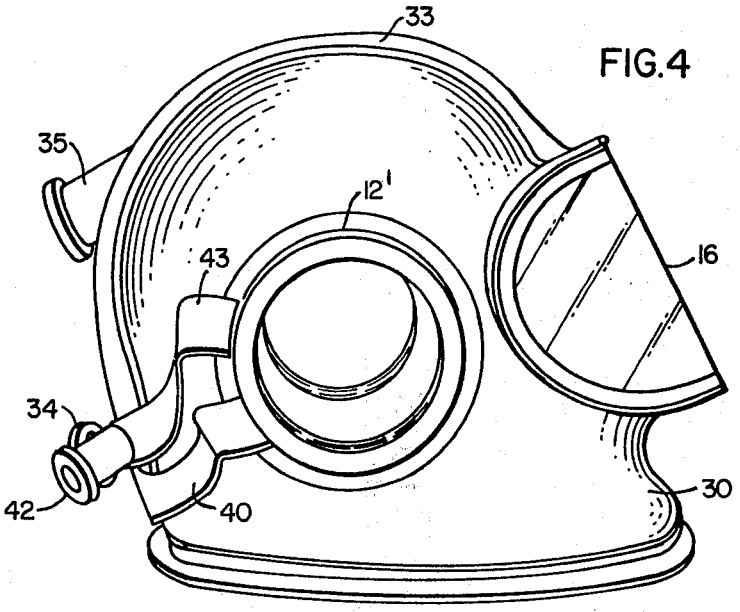
Figure 5:
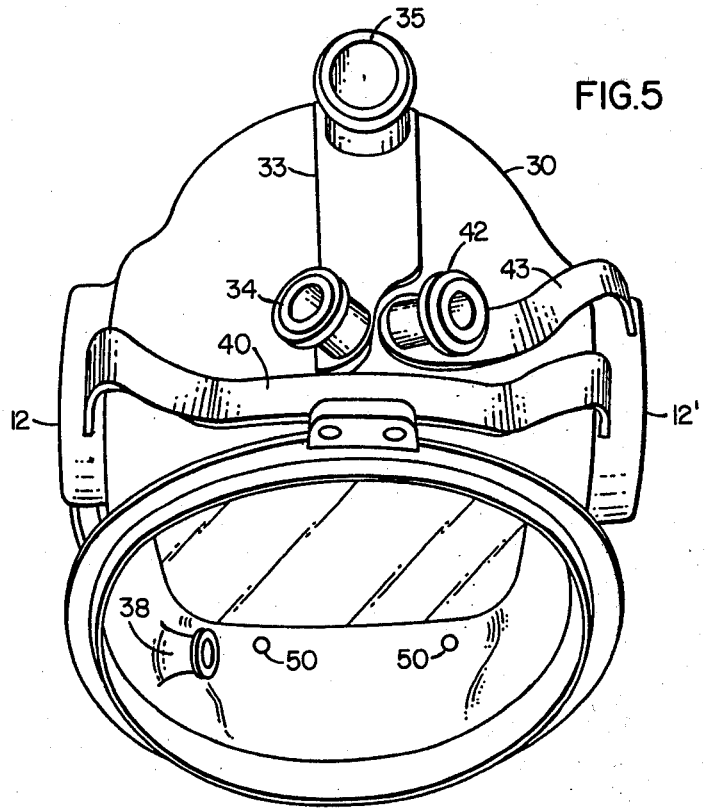

The helmet body construction is started with a helmet body shell 30 (e.g. fiberglass) three views of which are illustrated in FIGS. 3, 4 and 5. FIG. 3 is a view looking down at the left side and showing a portion of the front; FIG. 4 is a view of the right side; and FIG. 5 is a view of the rear portion looking up into the shell.

The skeletal inside shell of the helmet body serves as a platform for the optimal positioning and mounting of the various components for interfacing with the various breathing gas supply systems.

Connected to the helmet body shell is some multipurpose ducting, preferably fabricated of non-corrosive stainless steel, and utilized as gas passageways. For example, passing over the top of the shell 30 is a passageway or duct 33 which may be operable to receive breathing gas at either first input 34 or second input 35 and to deliver the gas to the inside of the helmet body at a position just above the window 16 whereby the discharge of gas through a discharge slit serves to defog the window. Diver exhaled gas is conducted to the left receiver 12, herein termed a valve receiver, by means of a first conduit in the form of exhaust duct 38. A portion of the exhaust duct 38 is outside the shell 30 as seen in FIG. 3 and a portion is inside the shell as seen in FIG. 5.

For various modes of operation, only the exhaust duct and valve receiver 12, in addition to the supply duct 33, would be needed. In order for the apparatus to be compatible with all gas supply systems, however, there is provided another valve receiver, 12', with the two valve receivers being communicative with one another by second conduit means in the form of interconnecting duct 40. Another fitting 42 is provided adjacent the input fitting 34 and this fitting 42 is communicative with the right valve receiver 12' by means of duct 43.

After the duct work and receivers are in position, there may be applied a thermal insulating layer, and on top of that, an outer protective skin resulting in a helmet appearance as in FIG. 1.

Figure 6:
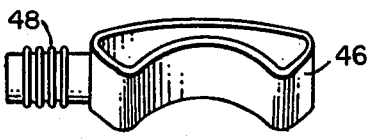
FIGS. 6 and 7 are respective views of a gas exhalation collector, and oral-nasal mask which can be utilized with the apparatus of the present invention.
Figure 7:
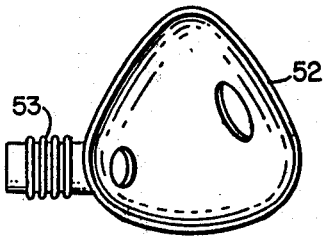

For some modes of operation, the diver will exhale into a soft molded exhalation collector 46, as seen in FIG. 6, the exhalation collector forming a collector funnel in the area of the diver's chin just below the mouth. The exhalation collector 46 is connected to the exhaust duct 38 by means of tube 48 which fits over the beaded end of exhaust duct 38. In use, snaps on the front of exhalation collector 46 are engageable with snap receptable 50 just below the window in FIG. 5. In other modes of operation, the oral-nasal mask 52 illustrated in FIG. 7 is utilized and is connected by means of tube 53 which fits over the beaded end of exhaust duct 38.

Figure 8:
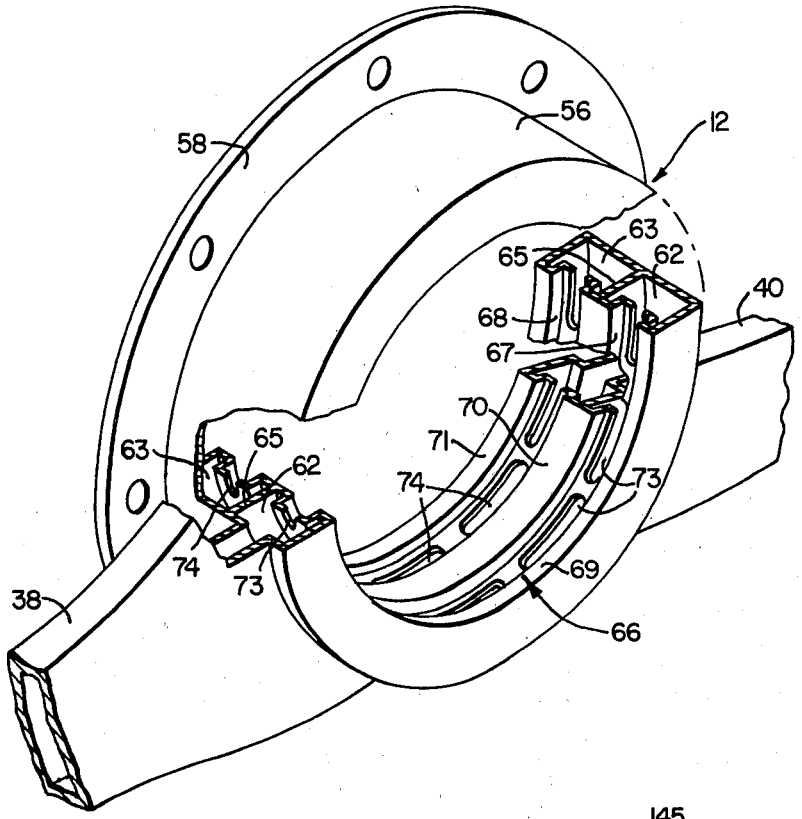
FIG. 8 is a view, with portions broken away, of the right valve receiver of the helmet.

In FIG. 8 there is illustrated in more detail, a typical receiver, the left one 12, with portions broken away to show the interior thereof. The valve receiver 12 has a body portion 56 and is secured to the helmet shell by means of a flange 58. The valve receiver 12 includes two annular plenum chambers 62 and 63 separated by a wall 65 with the plenum chamber 62 constituting the outer plenum chamber and 63, the inner plenum chamber. The inside surface 66 has defined therein two annular grooves 67 and 68 with adjacent land areas 69, 70 and 71 with the outer groove 67 being communicative with plenum chamber 62 by means of a plurality of annularly disposed openings 73. Annular groove 68 is, in a similar manner, communicative with the plenum chamber 63 by means of a plurality of annularly disposed openings 74. Receiver 12' would have the same structure.

Exhaust gas from exhaust duct 38 enters the plenum chamber 62 and is free to exit therefrom via the openings 73. The other plenum chamber 63 is communicative with the interconnecting duct 40 and gas communication to it is made by way of openings 74.

Basically, the diving helmet system of the present invention is adaptable to all three modes of gas supply systems and variations thereof. The three different modes of gas supply systems which will be discussed herein are the open circuit, the push-pull, and the diver worn units.

In the open circuit mode air, or mixed gas, is supplied from a remote source either on demand by the diver, or at a free flow rate, or combinations thereof.

In the push-pull mode, gas is supplied from a remote source for example an underwater habitat, and exhaled gas is returned to the habitat for $CO_2$ removal and oxygen replenishment.

The diver worn gas supply mode includes a variety of systems such as semi-closed or closed and either self-contained or supplied from a remote source, to name a few.

In some of the gas supply modes gas circulation is effected by diver lung power while in other modes, gas circulation is aided by power circulation devices or is supplied at a rapid enough rate for diver use.

In order to accommodate for the lung powered circulation, various ones of the ducts are of greater cross-sectional area. In the embodiment illustrated the first conduit, that is, the exhaust duct 38, and the supply duct 33 are larger than the other ducts.

The fittings on the supply duct likewise are of different diameters with the larger diameter input 35 being for the lung powered mode, in which mode the oral-nasal mask would be utilized.

The valve receivers 12 and 12' are operable to receive insertable gas flow control modules such as valves and offers the option of allowing different valves to be inserted, depending upon the gas supply mode, to communicate gas directly with the adjacent water, with exterior gas passageways added on, with the helmet or gas passageways of the helmet, or with the diametrically opposed valve receiver. Several flow control modules in the form of valves are schematically illustrated in FIGS. 9A through 9E.

Figure 9A:
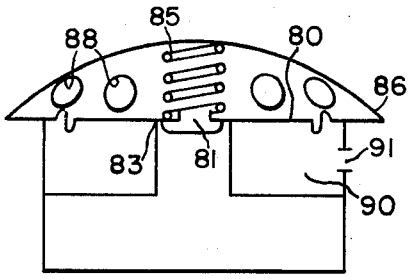
FIGS. 9A through 9E are schematic representations of various valving means which can be utilized in the present invention.

The valve of FIG. 9A includes a movable diaphragm 80 having a central aperture 81, the arrangement bearing on a valve seat 83. The closure is effected by means of a spring 85 having one end bearing against the membrane 80 and at its opposite end against a cover 86 having apertures 88 therein for communication with the surrounding water medium. Gas enters valve chamber 90 through opening 91 and when the pressure thereof exceeds a value equal to the water pressure acting on the membrane 80 and the spring closing pressure, gas will escape past the valve seat 83, through the aperture 81 to surrounding water medium. FIG. 9A therefore schematically represents a simple exhaust valve.

Figure 9B:
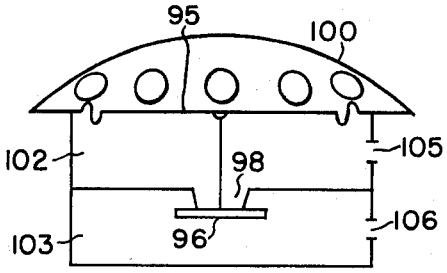

In FIG. 9B a flexible membrane 95 is rigidly connected to a valve disc 96 which closes aperture 98. An apertured cover 100 communicates the water pressure to the movable membrane 95 and when the water pressure is greater than the pressure in chamber 102 the valve will open allowing gas flow between chambers 102 and 103 respectively connected to openings 105 and 106.

Figure 9C:
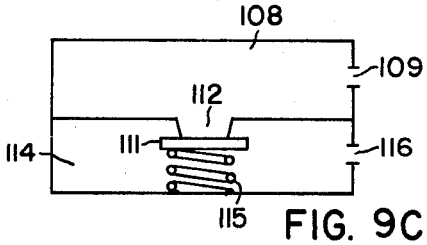

In FIG. 9C gas entering chamber 108 through opening 109 operates to force the valve disc 111 away from the aperture 112 against the pressure in chamber 114 and against the action of spring 115. When the valve disc 111 moves, gas communication is effected between openings 109 and 116.

Figure 9D:
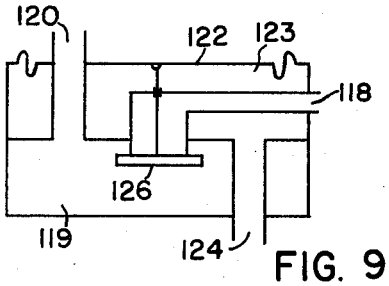

In FIG. 9D gas will flow from passageway 118 to chamber 119 and then out through passageway 120 when the pressure on the outside of membrane 122 is greater than the pressure communicated to chamber 123 by means of passageway 124. In such instance the valve disc 126 rigidly connected to the membrane 122 is forced to an open position.

Figure 9E:
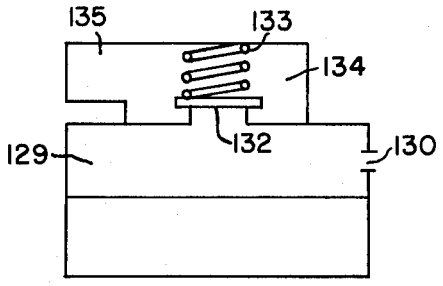
Figure 10A:
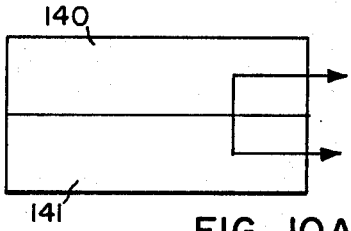
FIGS. 10A to 10D are block diagram representations of various valving means illustrating the gas flow control function.
Figure 10B:
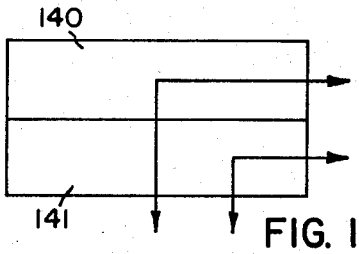
Figure 10C:
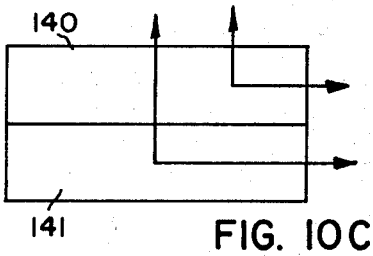
Figure 10D:
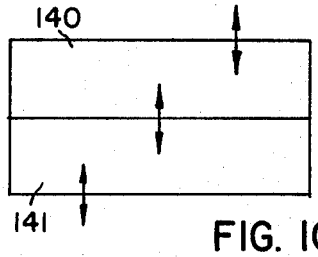

As another possible example of a valve assembly, FIG. 9E shows an arrangement whereby gas entering chamber 129 through opening 130 forces the disc 132 open against the closing force contributed by spring 133 and against the pressure in chamber 134. The gas entering the chamber 134 however, is collected in an exterior added on gas passageway 135.

The types of insertable modules that can be utilized may have various different designs depending upon their function. The valves which have been illustrated by no means cover the entire gamut of valve designs which are utilizable in the present invention. The design of particular valves to control the flow of gas in response to predetermined conditions and parameters, would be well known to those skilled in the art. In general, the modules may be represented as in FIGS. 10A through 10D which functionally illustrate by means of the double ended arrows the possible varieties of gas communication or flow between module chambers 140 and 141 and an exterior or interior ambient medium.

Figure 11:
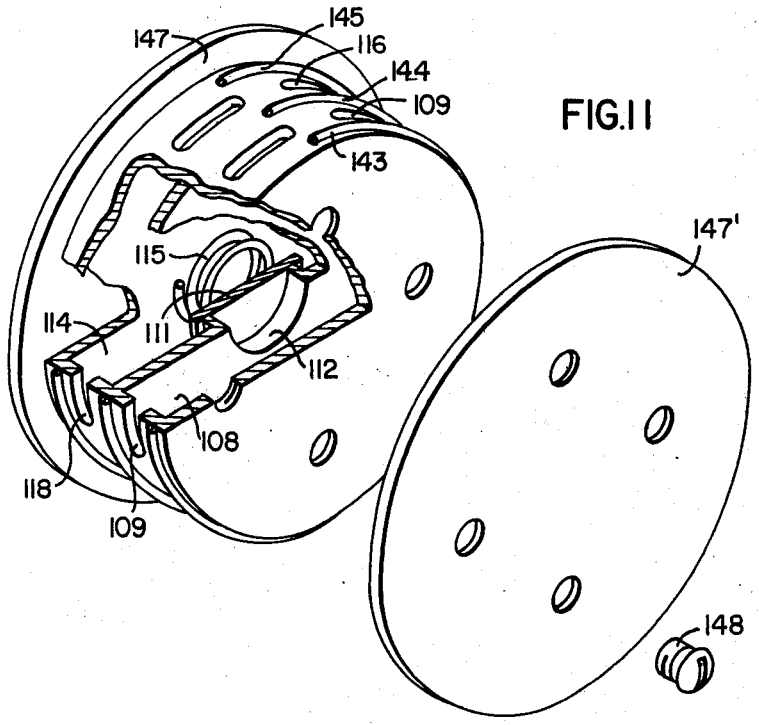
FIG. 11 is a view, with a portion broken away, of the valve illustrated in FIG. 10C.

A typical valve for insertion into a valve receiver of the present invention would appear as in FIG. 11 which illustrates the valve of FIG. 9C with a portion cut away. The module is generally cylindrical in shape and the apertures 109 and 116 manifest themselves in the form of elongated slits in the side wall portions of the module. With additional reference to FIG. 8, these openings 109 and 116 would respectively communicate with the grooves 67 and 68 and a gas tight seal is effected by means of peripheral seals in the form of O-rings 143, 144 and 145 which contact respective land portions 69, 70 and 71. (For clarity O-ring grooves have not been illustrated).

The insertable modules may be held in position by any one of a number of fastening methods. For example, the module of FIG. 11 includes a plate 147 of a diameter larger than the cylindrical opening of the valve receiver, so that it is prevented from passing therethrough. After insertion, (from the inside of the helmet) a similar plate 147' may be fastened to the opposite surface such as with bolts 148. For those modules which have communication with the surrounding water medium or the inside of the helmet other fastening arrangements may be utilized and the discs may have suitable perforations.

Figure 12A:
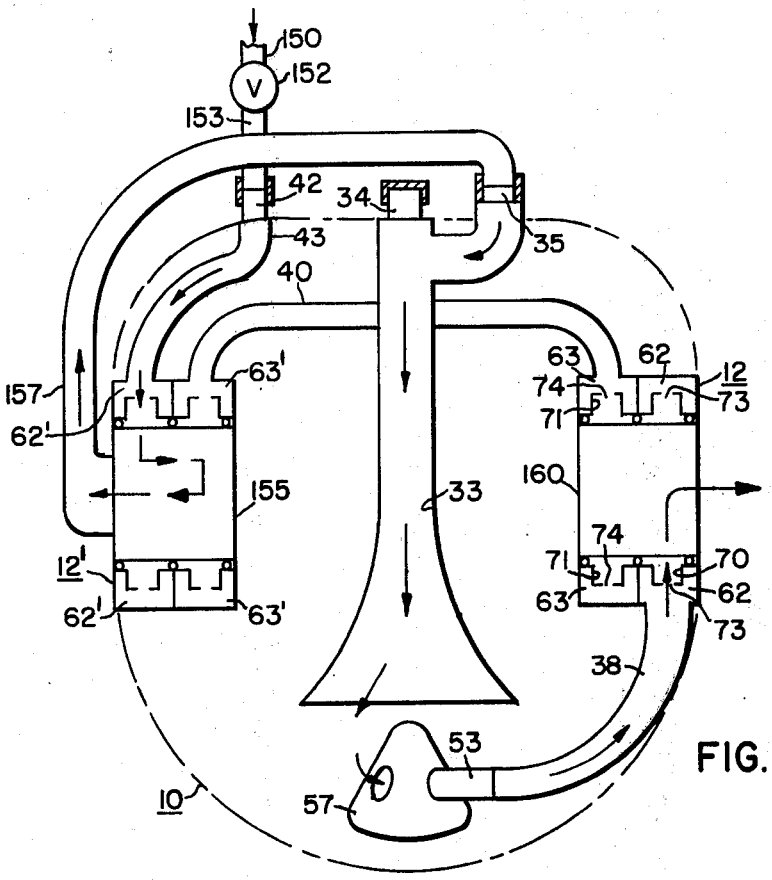
FIG. 12A is a gas circuit diagram of one mode of operation of the present invention.

FIG. 12A illustrates a lay-out of the diving helmet system components showing the gas flow circuit utilized in a first-type of gas supply system namely, an open circuit-demand valve arrangement. Breathing gas such as air or a helium-oxygen mixture is provided from a remote source via hose 150 to a control valve 152 worn by the diver. Valve 152 which may be a one way check valve supplies the gas by way of hose 153 to fitting 42 where it enters the plenum chamber 62' of the right valve recever 12'. A demand valve module 155 such as illustrated in FIG. 9D is inserted into the valve receiver 12' and the gas flow, as indicated by the arrow, communicates, upon certain predetermined demand conditions, the input gas to the externally mounted duct 157 connected to the gas input 35. The other gas input 34 remains unused and in a capped condition. In view of the fact that the diver's lungs are utilized to power the breathing gas around the gas circuit, the oral-nasal mask 57 is employed.

Figure 12B:
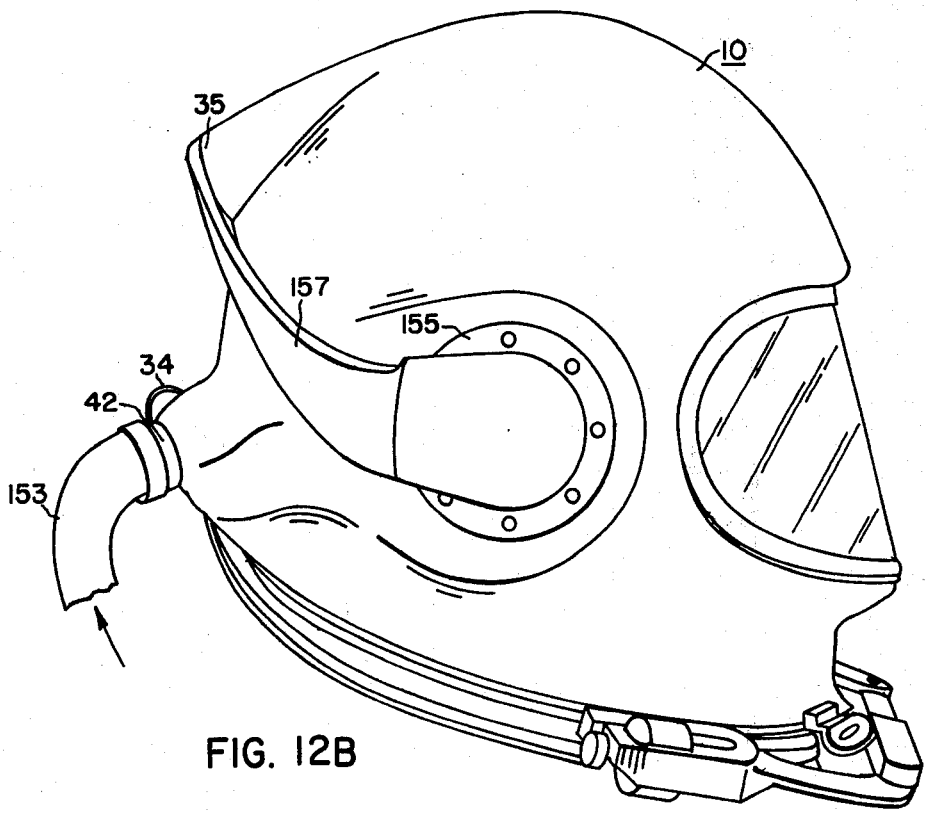
FIG. 12B illustrates the diver worn apparatus for the mode of FIG. 12A.

In the open circuit mode exhaled gas is conducted to the surrounding water medium and accordingly the module 160 in the valve receiver 12 may be an exhaust valve such as illustrated in FIG. 9A. The apparatus as worn by the diver would be as shown in FIG. 12B illustrating the actual arrangement of various components described in FIG. 12A.

Figure 13A:
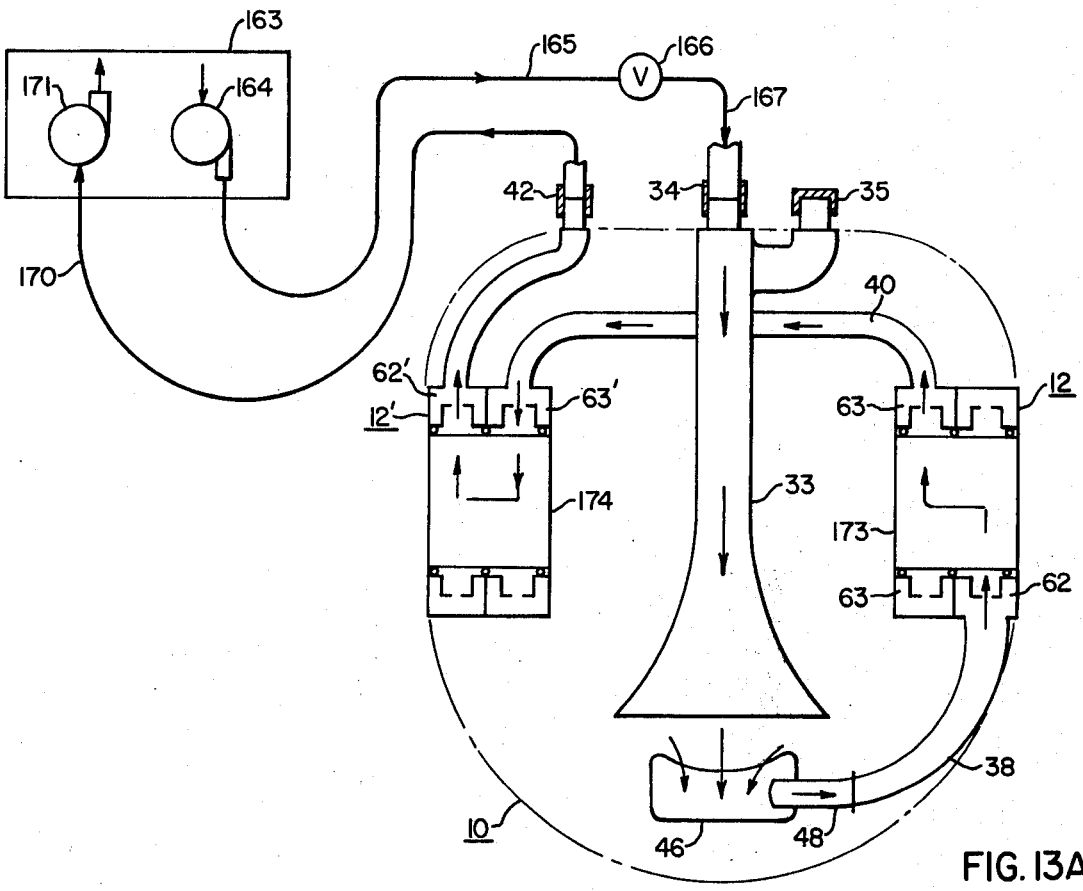
FIG. 13A is a gas circuit diagram of another mode of operation of the present invention.

FIG. 13A is a gas circuit as in FIG. 12A showing however, the push-pull gas supply mode. Breathing gas is supplied from an underwater habitat 163 by means of pump 164 and supply hose 165 to a diver worn control valve 166. The control valve 166 is connected by means of hose 167 to the input 34, the other input 35 being capped. Since the diver is not using his lung power to move the gas, the exhalation collector 46 may be utilized. In the pushpull mode, exhaled gas is returned to the habitat 163 by means of a return hose 170 and suction source 171 to be processed. Modules 173 and 174 are inserted into respective valve receivers 12 and 12' for directing the exhaled gas as indicated by the arrows. Accordingly, exhaled gas entering plenum chamber 62 of valve receiver 12 is conducted to plenum chamber 63, in response to predetermined conditions, travels through interconnecting duct 40 to plenum chamber 63' and then to plenum chamber 62' by way of module 174, after which connection is made to the return hose 170 at the fitting 42.

Figure 13B:
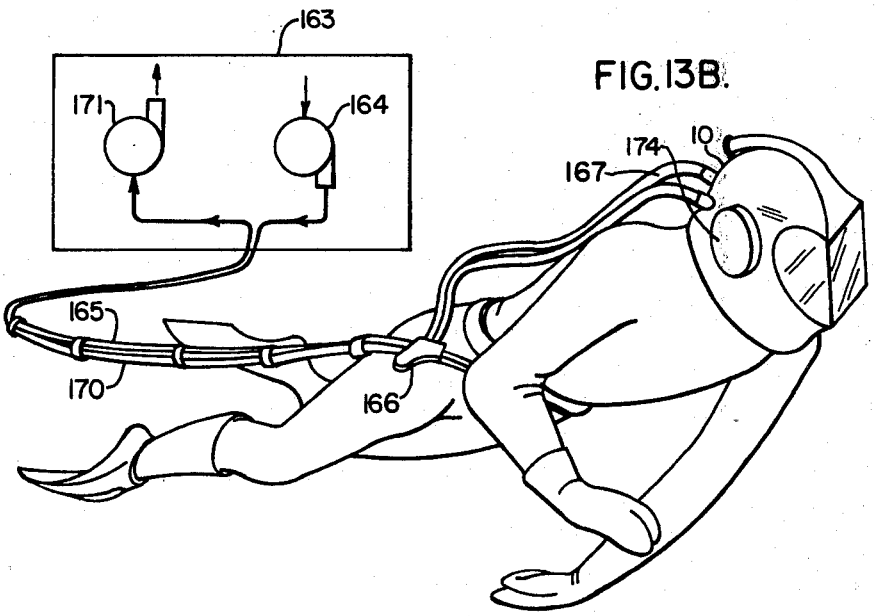
FIG. 13B illustrates the diver worn apparatus for the mode of FIG. 13A.

FIG. 13B illustrates, on the diver, the arrangement of FIG. 13A.

Figure 14A:
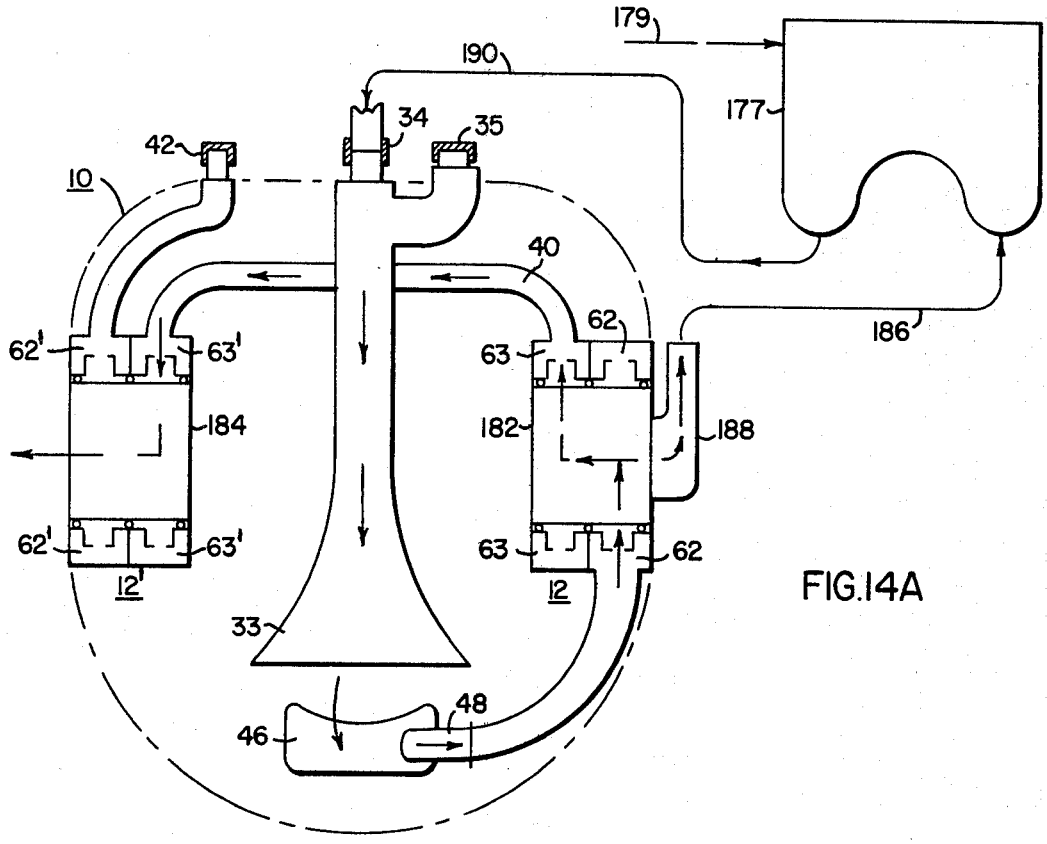
FIG. 14A is a gas circuit diagram of another mode of operation of the present invention.

FIG. 14A is a gas circuit similar to FIG. 12A however showing one of the diver worn arrangements, more particularly a semi-closed, powered circulation gas supply mode. A pack 177 is worn on the diver's back and includes such components as the power circulating means, carbon dioxide scrubber, breathing bags, oxygen sensor apparatus, to name a few. In some instances the back pack 177 can carry the breathing gas supply for the diver, however, for relatively long duration missions the gas can be supplied by way of a teather 179.

In the semi-closed mode of operation, a portion of the diver's exhaled breath is exhausted to the surrounding water medium while the remainder of the breath is recirculated for rebreathing, after $CO_2$ removal and oxygen makeup.

Accordingly, the module 182, inserted into valve receiver 12 is operable, as indicated by the arrows, to conduct a portion of the exhaled breath from plenum chamber 62 to plenum chamber 63 where it is routed through duct 40 to plenum chamber 63'. Module 184 inserted into valve receiver 12' conducts this exhaust gas to the surrounding water medium. In this semi-closed mode the module 182 is additionally operable to conduct the diver's exhaled breath to the back pack 177 by way of hose 186 and chamber 188.

After processing, the gas, in addition to newly added gas, is provided by way of hose 190 to the input 34 of the supply duct 33. Since there is a powered circulation, the exhalation collector 40 may be utilized, however, for non-powered circulation apparatus where the gas is moved around solely by the diver's lung power, the oral-nasal mask may be utilized and connections from the back pack 177 may be made to the large input 35.

Figure 14B:
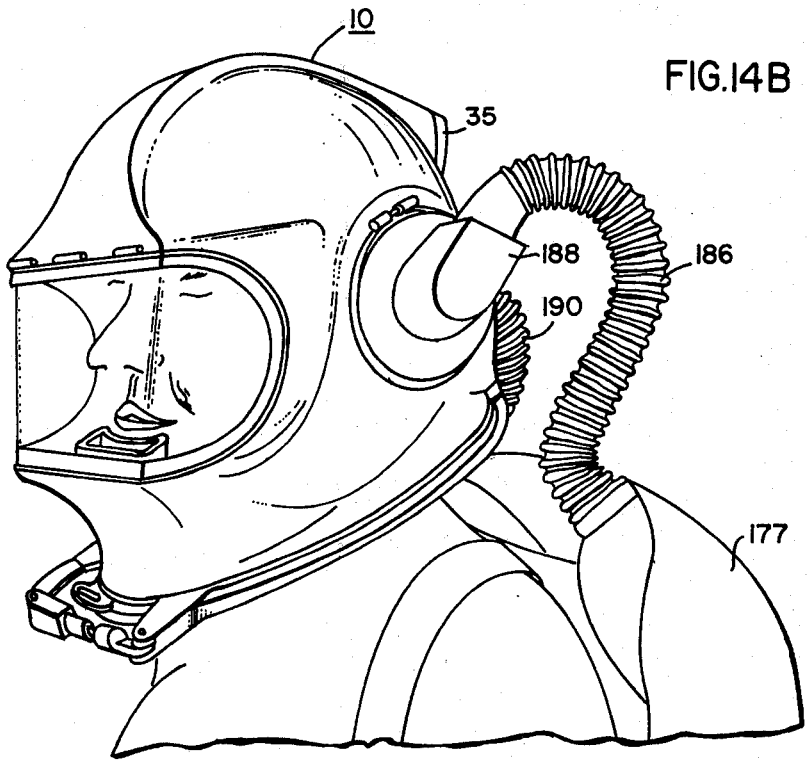
FIG. 14B illustrates the diver worn apparatus for the mode of FIG. 14A. Like parts have been given like reference numerals throughout.

The apparatus of 14A as would be worn by a diver is illustrated in FIG. 14B.

For some arrangements only one of the valve receivers may be needed, in which instance a plug module may be inserted in the other valve receiver. In order to equalize the pressures within the conduits of the helmet with respect to the surrounding ambient medium, such plugs may have communication with the interior of the helmet.

What is claimed is:

1. A diving helmet system comprising:

A. a diving helmet body;

B. said diving helmet body including a window;

C. said diving helmet system including receiver means constructed and arranged to receive insertable gas flow control modules;

D. a first gas flow control module removably supportable by said receiver means, to accommodate a first gas supply arrangement;

E. said helmet system being constructed and arranged to receive a second and different gas flow control module that can be removably supported by said receiver means to accommodate a second, and different gas supply arrangement;

F. gas passageway means for communicating the interior of said helmet body with an inserted one of said gas flow control modules; and G. sealing means for effecting a diving helmet to diver seal.

2. Apparatus according to claim 1 wherein

A. said receiver means includes first and second receivers; and wherein

B. said gas passageway means is a first conduit communicating the interior of said helmet body with said first receiver; and which includes C. second conduit means interconnecting said first and second receivers.

3. Apparatus according to claim 2 wherein:

A. said receivers are respectively positioned to the right and left of said window.

4. Apparatus according to claim 2 which includes:

A. a fitting on said helmet body; and

B. third conduit means connecting said second receiver with said fitting.

5. Apparatus according to claim 1 wherein:

A. said receiver means includes a receiver having a body defining at least one plenum chamber;

B. said gas passageway means being communicative with said plenum chamber;

C. said plenum chamber being in gas communication with an inserted one of said gas flow control modules.

6. Apparatus according to claim 2 wherein:

A. said first receiver has a body defining a plurality of plenum chambers;

B. said first conduit means being communicative with a first of said plenum chambers;

C. said second conduit means being communicative with another of said plenum chambers.

7. Apparatus according to claim 6 wherein:

A. said second receiver has a body defining a plurality of plenum chambers;

B. said second conduit means being communicative with a first of said plenum chambers;

C. said third conduit means being communicative with another of said plenum chambers.

8. Apparatus according to claim 6 wherein:

A. said plenum chambers are annular plenum chambers.

9. Apparatus according to claim 8 wherein:

A. the body of said first receiver defines a plurality of annular grooves each adjacent a respective one of said plenum chambers;

B. said grooves having apertures disposed thereabout for gas communication with its respective plenum chamber.

10. Apparatus according to claim 9 wherein:

A. said second receiver has the same structure as said first receiver.

11. Apparatus according to claim 9 wherein:

A. said grooves have adjacent land portions;

B. an insertable module, including a plurality of peripheral seals;

C. each one of said seals contacting a respective one of said land portions.

12. Apparatus according to claim 1 which includes:

A. a breathing gas supply conduit in gas communication with the interior of said diving helmet body;

B. first and second gas inputs connected to said breathing gas supply conduit;

C. said second input being of a larger size than said first input.

13. Apparatus according to claim 1 which includes:

A. a breathing gas supply conduit having a gas input at the rear of said helmet body;

B. said supply conduit extending from said rear to a position above said window and terminating in a discharge slit whereby incoming gas aids in defogging said window.

14. Apparatus according to claim 1 wherein:

A. said gas passageway means is a first conduit having an end within the interior of said helmet body; and which includes;

B. an exhalation collector connected to said end;

C. said exhalation collector being positioned to contact the wearer just below the mouth for conducting exhaled breath to said first conduit means.

* * * * *